US005732879A

United States Patent [19]

Low

[11] Patent Number: 5,732,879

[45] Date of Patent: Mar. 31, 1998

[54] COMFONT CONTROL BY COMBINED TEMPERATURE AND HUMIDITY

[75] Inventor: David Nicholson Low, Wilmington, Del.

[73] Assignee: David N. Low, Wilmington, Del.

[21] Appl. No.: 514,617

[22] Filed: Aug. 14, 1995

[51] Int. Cl.[6] ..... B01F 3/02; H01H 35/42

[52] U.S. Cl. ..... 236/44 R; 200/61.06; 374/109; 236/DIG. 13

[58] Field of Search ..... 62/176.6; 236/44 C, 236/44 R, DIG. 13, 101 D; 374/109; 337/378; 200/61.06

[56] References Cited

U.S. PATENT DOCUMENTS 1,807,306 5/1931 Colman ..... 236/DIG. 13

2,949,513 8/1960 Davidson ..... 236/DIG. 13

3,080,465 3/1963 Pelishek ..... 200/138

4,350,023 9/1982 Kuwabara et al. ..... 236/49.3

*Primary Examiner*—William E. Wayner

[57] ABSTRACT

A method and thermostat for controlling comfort in an area with temperature altering equipment, but no specific humidity altering equipment. An on-off thermostat which mechanically combines temperature and humidity measurements in a predetermined ratio based on a user's perception of comfort. The thermostat does not require an anticipator when used with an air conditioner in a warm and humid climate.

6 Claims, 4 Drawing Sheets

WINTER

SUMMER

9 = 9A + 9B

COMFONT CONTROL BY COMBINED TEMPERATURE AND HUMIDITY

BACKGROUND OF THE INVENTION

1. Field of the Invention

This invention relates in general to controlling home heating and cooling equipment and in particular to homes that have no direct humidity control such as for example, but not limited to, a hygrometer controlled water spray into a home's heating or cooling air duct.

2. Description of Prior Art and Related Art

Most home air conditioners and heating systems are controlled by a thermostat which responds only to dry bulb temperature. However, the temperature response of a usual bimetallic thermal element in a thermostat is inherently slow in measuring air temperature which causes excessive deviation of the controlled temperature. To correct this problem, a low power electric heater is usually placed within or close to the bimetallic element. For heating applications current passes through the heater during the "furnace-on" part of the cycle. For air conditioning, power is applied to the heater during the "air conditioner-off" part of the cycle. The heater partially compensates for the lag of the bimetallic element in measuring air temperature, and it is called an anticipator. However, because the electric heater itself has mass, it adds to the measuring lag when its current is off. Current to the electric heater is also difficult to properly adjust, and it is usually effected by the load in its external circuit.

A heating system thermostat responding to temperature and humidity is described by U.S. Pat. No. 3,080,465 (1963) to R. A. Pelishek. This device, which does not have an anticipator, attaches a humidity sensitive material directly to one side of a its bimetallic coil. The humidity sensitive material partially insulates the coil and also expands in opposition to the bimetallic coil during the "heat-off" part of the room heating cycle. Both of these features further slow the already slow response of a bimetallic coil to temperature changes. The direct attachment of the humidity sensitive material to the coil also prevents the use of an anticipator which is normally used to offset the slow thermal response of a bimetallic coil. No calibration data is given for the thermostat, and there is no way to adjust its sensitivity to humidity or to tailor its response to match an individual's perception of effective temperature.

Usually the thermostat accepts a control point or desired operating temperature from the user. In the case of heating, whenever room temperature falls below the control point the thermostat starts heating equipment which continues until room temperature matches the control point. Conversely, in an air conditioning system the thermostat starts cooling equipment which runs until room temperature falls to the control point temperature.

A problem with the just related sequence is that the user often sets the control point as close as possible to the threshold of being uncomfortable for economic reasons. For heating, the control point is often set at the lowest comfortable temperature. For cooling it is often set at the highest comfortable temperature. At these marginal settings a difficulty arises if there is a change of humidity in the air. During cooling season an increase in humidity will cause warm discomfort. In winter a decrease in humidity will cause cool discomfort. To avoid the periods of discomfort, the homeowner will often "back off" from the most economical control point setting which means more fuel in winter and more electrical energy in summer.

The object of this invention is to allow a user, who has no direct humidity control equipment, to continuously use the most economical room temperature control point settings without causing him discomfort during periods of adverse humidity.

SUMMARY OF THE INVENTION

This invention is a method to control simple heating or air conditioning systems (those which have no direct humidity control equipment) as a function of "comfort" instead of dry bulb temperature along. The "comfort" method allows a user to combine dry bulb temperature and a humidity measurement of room air to arrive at a line or continuous function of "comfort" as he perceives it. This function is then used as a moving control point for the heating or cooling equipment. The comfort method automatically adjusts the dry bulb temperature control point to compensate for changes in relative humidity that may cause discomfort or uneconomic operation of heating or cooling equipment. This action makes it practical to set the control point at the threshold of discomfort (most economical operation) without excursions into discomfort caused by unfavorable humidity conditions.

DETAILED DESCRIPTION OF THE INVENTION

Because the thermally sensitive elements used to control most home heating and cooling systems respond only to dry bulb temperature, the comfort or lack of comfort at any given time can vary depending upon the relative humidity or moisture in the air. It is well accepted that high dry bulb temperatures in a desert are not too oppressive because R.H. (relative humidity) is low, 20%–30% for example, and the evaporation of perspiration cools the body. If on the other hand R.H. increases to 90% at the same dry bulb desert temperature, then perspiration evaporation from the skin is greatly reduced, skin temperature climbs and comfort is lowered. Although the desert example is extreme, similar human responses to a lesser degree apply at room temperatures and humidities.

The method of this invention makes use of the well known phenomenon described above by assuming that there is a continuous function of comfort that depends upon dry bulb temperature and percent R.H. of an air space, and that the two properties are somewhat interchangeable with regard to comfort. That is to say, if a person is comfortable at a warm temperature and a certain amount of moisture in the air, then he will be equally comfortable at a lower temperature if moisture in the air is increased to a particular higher value.

Figure 1:
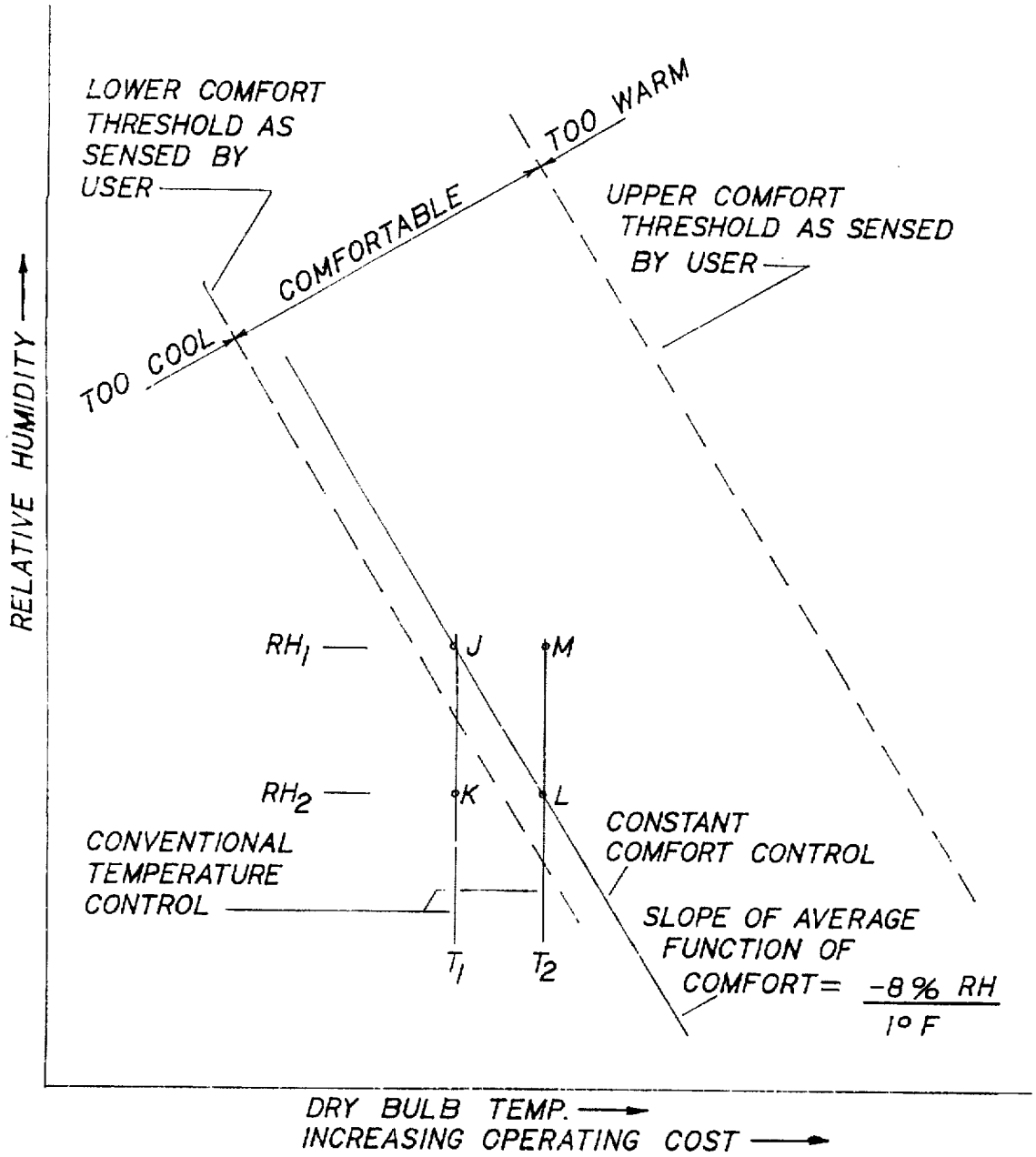
FIG. 1 is a plot of percent relative humidity representing moisture vs dry bulb temperature as may be encountered in a space to be heated in winter for human comfort and where there is no equipment for altering humidity. The vertical lines represent constant temperature control as performed by a conventional thermostat without regard for moisture changes in the room air. The solid sloped line represents a moving control point of constant comfort as proposed by the method of this invention. The dashed sloped lines represents the thresholds of comfort. The lower threshold line represents the lowest combinations of temperatures and humidities without discomfort as sensed by a particular user and also the most economical control points.
Figure 2:
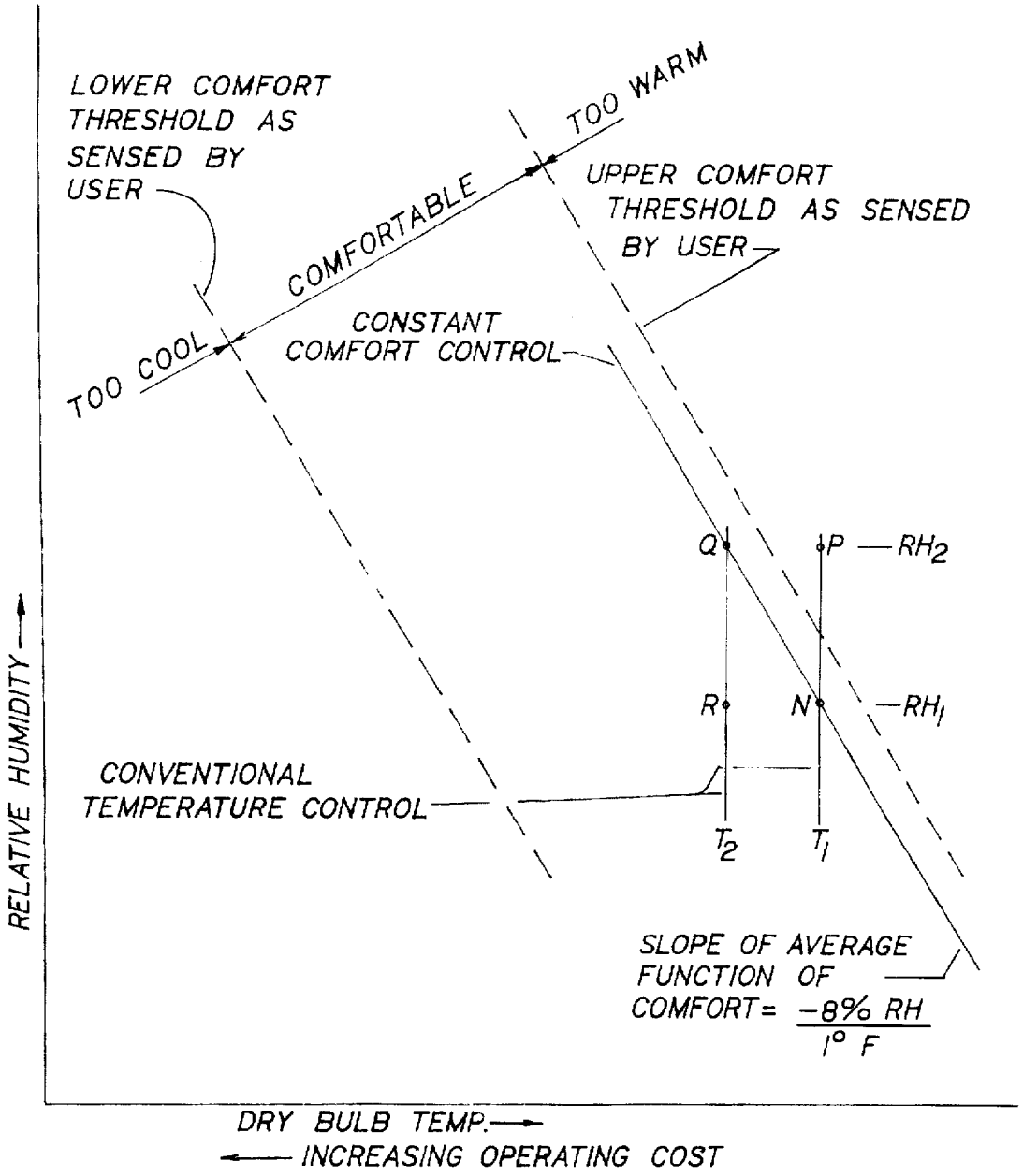
FIG. 2 is similar to FIG. 1, except that it represents a summer situation where a space is being cooled for human comfort without direct humidity control. In this case the upper comfort threshold represents the highest combinations of temperatures and humidities without discomfort as sensed by a particular user and also the most economical control points.

The sloped lines in FIGS. 1 and 2 embody the above principle, and they are similar to "effective temperature" lines as described by the A.S.H.V.E. (American Society of Heating and Ventilating Engineers) Comfort Chart For Continuous Occupancies Of More Than Three Hours Duration—from the 1935 Guide. The subject is also discussed on page 12 of the Trane Air Conditioning Manual—1948 edition. From the manual, "Effective temperature is not an actual temperature in the sense that it can be measured by a thermometer. It is an experimentally determined index of the various combinations of dry and wet bulb temperatures under which most people feel equally cool or warm. It is not, in general, and index of comfort."

However, in the limited context of this invention where temperature and humidity changes are small around a comfort point determined by a user, the slope of the effective temperature line can be used with many individuals to direct changes in dry bulb temperature which will compensate for variations in relative humidity. While effective temperature applies to the average comfort of a large number of individuals, it may not be the most comfortable temperature-humidity combination for any particular individual. This invention allows an individual user to pick a function of comfort that matches his own perception of effective temperature, which is especially valuable when the control point is set near the threshold of the user's discomfort for minimum energy cost.

This last concept can be further explained using examples and by referring to FIGS. 1 and 2. In the following paragraphs, cases are used to compare home heating and cooling as controlled by a conventional thermostat and by a controller using the proposed comfort control method of this invention.

Referring to FIG. 1, the two dashed lines are similar to effective temperature lines, and they represent extreme limits of comfort as sensed by a user in a home without humidity control equipment. The vertical lines T1 and T2 represent operation of a typical heating system using a conventional thermostatic control sensitive only to dry bulb temperature. The constant comfort line (or function of comfort) represents a controller operating according to the method of this invention.

In the first heating case using a conventional thermostat, the user sets the control point at T1 and R.H.1 where he is marginally comfortable at J. This is also an economical control point near the threshold of discomfort. However, if humidity decreases to R.H. 2 for any reason, the user will be too cool and out of the comfortable zone at a point like K. As a likely response, the user will raise the control point to T2 which places him back in the comfortable zone at some point L, but at a higher operating cost. If humidity should return to R.H.1, conditions will still be in the comfortable zone, but at some point M with the continued higher operating cost of T2. Since the move from L to M causes little or no change in comfort, there is no impetus for the user to return the control point to T1. If the user realizes the change that has taken place and returns the control point to T1, it is likely that the same sequence will reoccur requiring the higher control point temperature each time the R.H. drops and lowering of the control point when normal R.H. returns. After several such cycles of readjustment, the user is likely to leave his control point at T2 so that the heater will take care of the worst condition of low humidity—but at the higher operating cost.

In the second case using a controller operating by the method of this invention (referred to as a comfort controller), the user places his control point at J as before with marginal comfort and minimum fuel cost. If R.H. drops from R.H.1 to R.H.2 as before, the comfort controller automatically increases the control point from T1 to T2 at L with no participation by the user and no excursion out of the comfortable zone. If R.H. as in the first case returns to R.H.1, the comfort controller automatically reduces the control point to T1 with its lower operating cost. It is likely with the above sequence caused by the comfort controller that the user will leave his control point at T1 with its lower operating cost.

FIG. 2 shows summer cooling conditions for a conventional temperature controller and for a proposed comfort controller. FIG. 2 is almost a mirror image of FIG. 1. A user with a conventional thermostatic controller and seeking the most economical use of his air conditioner will place his control point near the upper limit of comfort such as N with R.H.1 and temperature T1. If humidity increases to R.H.2, temperature and humidity will be out of the comfortable zone at some point P. To return to the same level of comfort as N, the user will lower his control point to T2 which places him at temperature-humidity combination Q, again in the comfortable zone, but at a higher operating cost. If humidity decreases to its original level R.H.1, the user will remain comfortable at some point R, but at the lower temperature T2 which requires more energy than necessary to stay in the comfortable zone. Since there is no impetus for change, such as discomfort, the user is likely to leave his temperature control point at T2 with its higher operating cost. If the user realizes what has happened and raises the control point back to T1, it is likely that the same sequence will reoccur requiring a lower control point each time the R.H. increases and an increase of the control point when normal R.H. returns. After several such cycles, the user is likely to leave his control point at the lower T2 so that the air conditioner will cool during the worst humidity condition—at the higher operating cost.

In the second cooling case with a controller operating by the method of this invention, the user places his control point at N as before with marginal comfort and minimum cost for energy. If the R.H. increases to R.H.2 as before, the comfort controller will automatically decrease its control point from T1 to T2 at Q with no participation by the user and no excursion out of the comfort zone. If R.H. as in the previous case decreases to R.H.1, the comfort controller will automatically raise its control point to T2 with its lower energy cost. It is likely that with this sequence caused by the comfort controller the user will leave his control point at the higher T1 with its lower operating cost.

To implement the sequences described above, the method of this invention requires combining dry bulb temperature and humidity measurements to generate a personal "function of comfort" that is used to determine the operation of heating or cooling equipment. The method combines the two measurements in a relationship that generates a function that is an "effective temperature" as perceived by a user to give constant comfort to his habitable air space.

The slope of the average function of comfort is −8% R.H./1 degree F.(Fahrenheit). However, because users sense comfort differently, the method requires a means for varying the slope of the function of comfort continuously from at least −5% R.H./1 degree F. to −11% R.H./1 degree F., but a wider adjustment is not excluded. The method also requires a means for translating or moving the function of comfort horizontally (refer to FIGS. 1 and 2) so that the control point can be adjusted. Ranges covered by the measurements should be at least 10% R.H. to 95% R.H. and 60 degrees F. to 85 degrees F., but not limited to these values.

The following example shows an estimate of the potential energy savings that can result from using the comfort control method with an air conditioning system. Assume an average function of comfort=−8% R.H./1 degree F.

Suppose that a room were being cooled to a comfortable 76 degrees F. and 65% R.H. from an outside temperature of 90 degrees F. If room R.H. were to decrease to 57% for any reason, the comfort controller would allow room temperature to rise to an equally comfortable 77 degrees F. before starting the air conditioner. As long as the R.H. remains at 57%, the operating cost for the air conditioner will be down by approximately 7%.

$$77\ F.-76\ F./90\ F.-76\ F.\times 100=7\%$$

Figure 3:
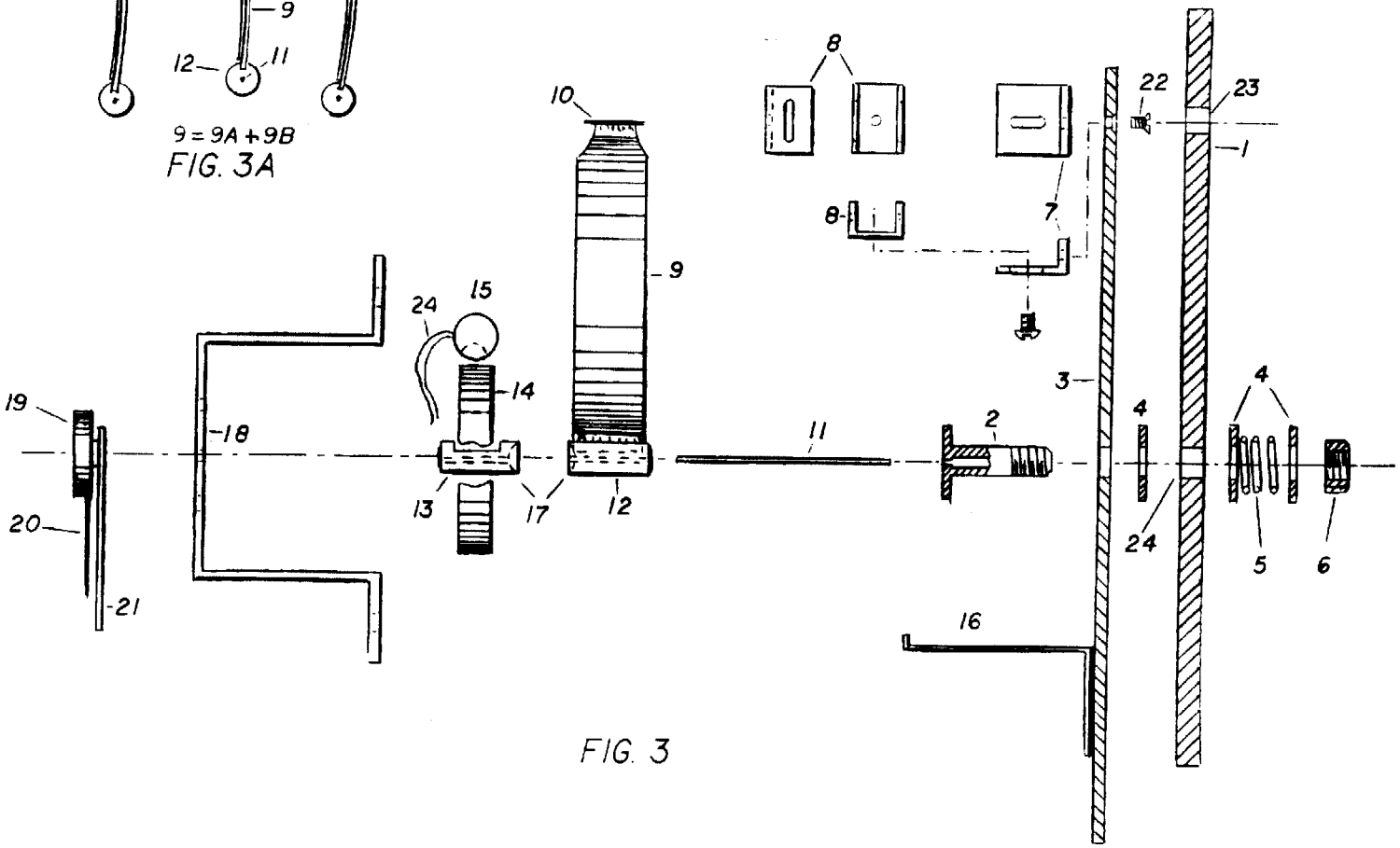
FIG. 3 is an exploded view of a thermostat that combines moisture as percent relative humidity and dry bulb temperature to generate the sloped line representing a function of comfort in FIGS. 1 and 2.
Figure 4:
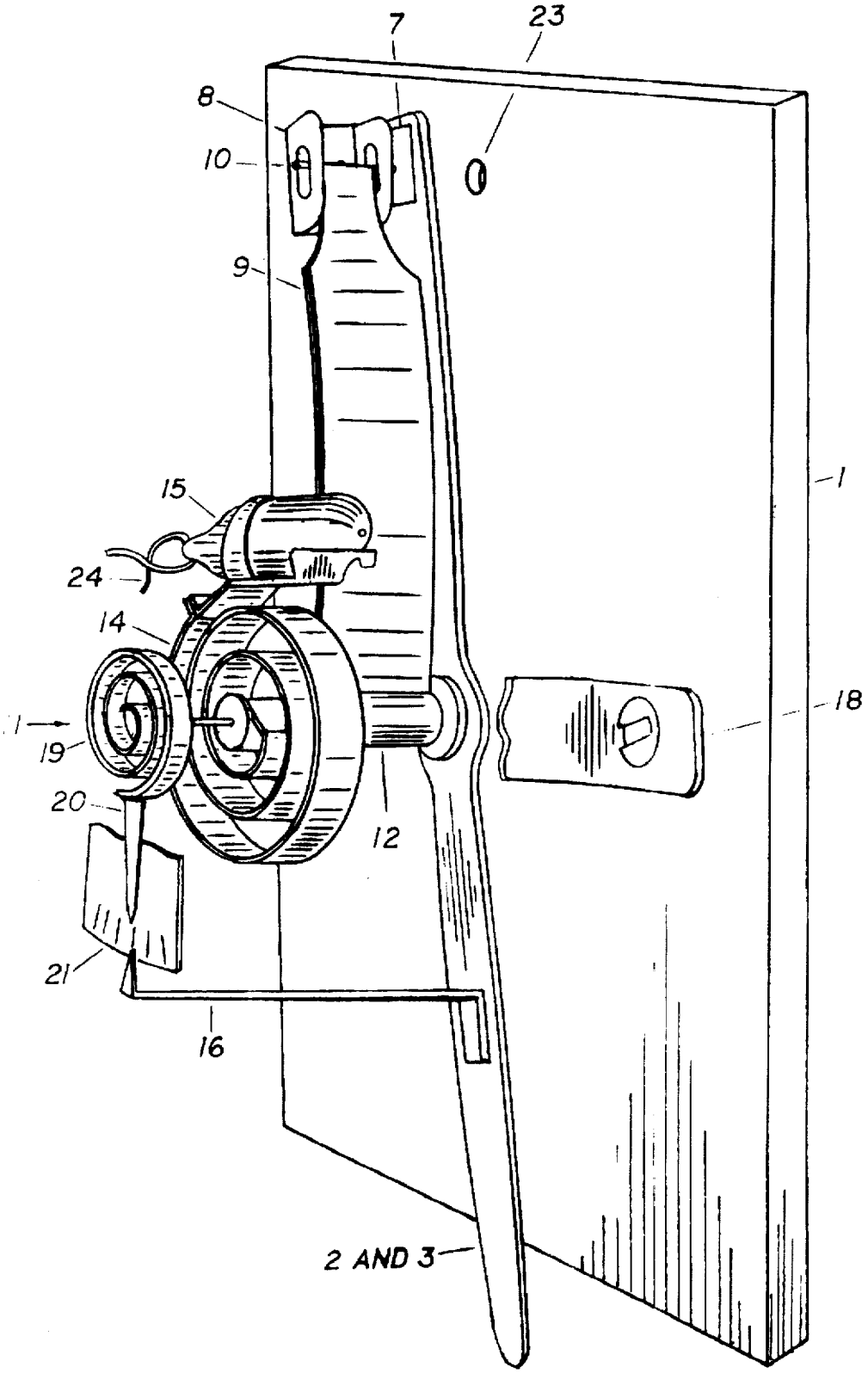
FIG. 4 is an assembly drawing of the same device as in FIG. 3 to more clearly explain its construction and operation.

Construction details of a comfort controller are not critical to the method of this invention, but a humidity and temperature sensitive thermostat which accomplishes this method is shown by FIGS. 3 and 4.

Basically, a humidity sensitive member 9 causes a shaft 11, 12 and 13 to rotate with changes in humidity. Shaft 11, 12 and 13 carries a temperature sensitive bimetallic coil 14 which in turn carries a mercury switch 15 for operating a heating or a cooling device. Humidity sensitive member 9 is thermally spaced from temperature sensitive bimetallic coil 14 so that an anticipator can be used without effecting the measurement of humidity sensitive member 9. Humidity sensitive member 9 is attached to shaft 11, 12 and 13 so that increased relative humidity causes said shaft 11, 12 and 13 to rotate in the same direction as bimetallic coil 14 rotates said mercury switch 15 on increasing temperature. In other words, increasing relative humidity and increasing temperature are additive in rotating or tilting mercury switch 15. A pin 10 attached to the free end of humidity sensitive member 9 moves in a confined direction in slots 8 which is used to connect member nine to a control point adjusting lever 3.

Figure 3A:
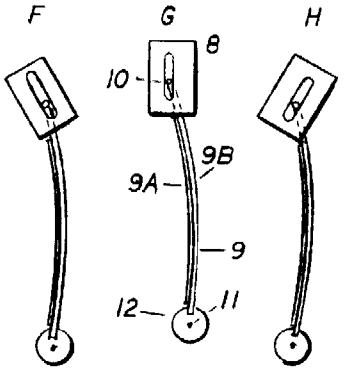

The nominal amount of rotation imparted to mercury switch 15 by temperature and humidity changes is such that if an increase in temperature of 1 degree F. causes a unit of rotation of switch 15, an 8% increase in R.H. will cause an additional unit of rotation of switch 15 in the same direction. This ratio of rotation generates the average slope (−8% R.H./1 degree F.) of the functions of comfort lines shown by FIGS. 1 and 2. The slope of the function of comfort lines (FIGS. 1 and 2) can be varied from −5% R.H./1 degree F. to −11% R.H./1 degree F. to match an individual's perception of effective temperature. This variation is done by rotating slots 8 from its normal radial position to direct more or less of the motion of humidity sensitive member 9 toward rotation of shaft 11, 12 and 13. This adjustment is shown in FIG. 3A by views F (attenuated rotation of shaft 11, 12 and 13), G (radial position—normal rotation of the shaft) and H (amplified rotation of the shaft) for a unit change in R.H.

If a user chooses to pick a personal function of comfort other than the average value of −8% R.H./1 degree F., he should experience a number of humidity cycles while noting a nearby hygrometer and his own perception of comfort. With this information the user can decide if he wants more or less response to changes in humidity and rotate slots 8 in a direction as shown by FIG. 3A to give his desired function of comfort. The process should be repeated until the user no longer perceives a need for a change in the function of comfort.

In the embodiment of this invention shown by FIGS. 3 and 4, the various parts may be made of any materials that meet the functional requirements of the particular part. However, brass has been satisfactory for most of the miscellaneous metal parts, except as noted in the following description. For base 1, it is preferred that the material have low thermal capacity and high electrical resistance for intrinsic safety—such as electrical grade FORMICA®. Control point adjusting lever 3 is permanently mounted on rear bearing 2. Rear bearing 2 is held in close fitting hole 24 in base 1 by lock nut 6 which partially compresses spring 5 to provide friction between base 1 and rear bearing 2 so that adjusting lever 3 will remain at any set position. Washers 4 separate the various parts along rear bearing 2. The upper end of adjusting lever 3 carries bracket 7 on which is mounted a pair of slots 8 which guide the free end of humidity sensitive member 9. Bracket 7 between adjusting lever 3 and slots 8 allows for rotation of slots 8 which changes the slope of the function of comfort as shown in FIGS. 1 and 2. Hole 23 in base 1 gives access to screw 22 which holds bracket 7 and permits this adjustment. The opposite end of adjusting lever 3 is exposed to the user, and it is used to adjust the operating control point (move the comfort control line horizontally in FIGS. 1 and 2). Adjusting lever 3 carries a pointer 16 which indicates the approximate control point of warmth or coolness on temperature scale 21.

Shaft 11, 12 and 13 is made up of two lengths of engineering plastic 12 and 13 such as DELRIN® drilled to fit snugly over center shaft 11 (0.35" dia. music wire for example). Center shaft 11 provides for low friction bearings while larger diameter plastic shafts 12 and 13 allow for attaching humidity and temperature sensitive members 9 and 14 to shaft 11, 12 and 13. Humidity sensitive member 9, further described later, is fixed into a radially machined slot in plastic shaft 12 using DEVCON® plastic welder for example. Plastic shaft 13 is provided with a "flat" to which is glued the flattened center of bimetallic coil 14. Glue cavities 17 on mating ends of plastic shafts 12 and 13 permit joining bimetallic coil 14 and humidity sensitive member 9 in their desired relationship when final assembly is made.

Humidity sensitive member 9 may be made from any relative humidity sensitive material 9A such as heavy paper glued to a thin piece of material with a spring characteristic that is insensitive to humidity 9B such as brass shim stock for example. This combination of paper glued to shim stock brass gives the humidity sensitive member the form of a laminated strip. It is well known that when such a laminated strip is exposed to changes in relative humidity, the strip will bend away from humidity sensitive side 9A as that side expands while the brass side 9B retains its length. This bending of humidity sensitive member 9 with changes in relative humidity is used to impart rotational motion to shaft 11, 12 and 13. One end of humidity sensitive member 9 is radially fixed to plastic shaft 12 while the opposite end is guided by attached pin 10 in slots 8 which are normally radial to shaft 12. By using slots 8 to limit the movement of pin 10 to one direction, maximum rotation is imparted to shaft 11, 12 and 13 from humidity sensitive member 9. Changes in the angle of slots 8 from the radial position cause changes in the amount of rotation of shaft 11, 12 and 13 for a unit changes in relative humidity. Slots 8 carrying pin 10 also serves to connect humidity sensitive member 9 to control point adjusting lever 3.

An infinite combination of materials and dimensions can be used in making humidity sensitive member 9. However, as a general guide, thicker or stiffer or shorter lengths of the spring component of member 9 give less rotation to shaft 11, 12 and 13 for a unit change in relative humidity. More width for humidity sensitive member 9 gives more power to rotate shaft 11, 12 and 13 carrying bimetallic coil 14 and switch 15. Humidity sensitive member 9 should be stiff enough to avoid any significant rotation of shaft 11, 12 and 13 caused by movement of mercury in switch 15. As an example, a suitable humidity sensitive member was made using 0.011" thick photographic paper glued with epoxy to 0.007" thick brass shim stock trimmed to 7/16"41 wide by 2 3/16" long. Humidity sensitive member 9 may be glued with an initial curvature of approximately 5" radius with the humidity sensitive material inside the curvature, but this is not critical to its operation. The above combination of materials and dimensions gave 1 degree of rotation to shaft 11, 12 and 13 for an 8% change in relative humidity.

A short length of small wire (the same as used for center shaft 11 is acceptable) is used to form pin 10 which may be glued with epoxy to the free end of humidity sensitive member 9. Pin 10 should fit into slots 8 without perceptible friction or clearance.

A bimetallic coil 14 can be obtained along with a mercury switch 15 from a conventional wall type thermostat such as a Minneapolis-Honeywell model T88B for example, or it may be purchased from a manufacturer such as Precious Metals, Inc. 1704 Borns St., Reidsville, N.C. 27320. If the bimetallic coil is to be used with the previously described humidity sensitive member 9, it should be purchased to produce 1 degree of rotation for a 1 degree F. change in temperature.

To make a subassembly, plastic shafts 12 and 13 carrying humidity sensitive member 9 and bimetallic coil 14 are threaded onto center shaft 11. The subassembly is allowed to equilibrate at some desired "center" temperature and relative humidity conditions (for example 70 degrees F. and 50% R.H.). Plastic glue is placed in cavities 17 and allowed to join shafts 11, 12 and 13 into a single unit so that switch 15 is level when adjusting lever 3, connected to humidity sensitive member 9, is in the center of its operating range. Small alignment adjustments can be made by judiciously bending humidity sensitive member 9. Adjusting lever 3 may be in any desired orientation, but vertical or horizontal positions at mid scale are preferred.

Shaft 11, 12 and 13 is supported by rear bearing 2 and out-board bearing bracket 18. These bearings should be without detectable friction or clearance. In FIG. 3 bracket 18 is shown 90 degrees from its assembly position to better show its shape.

Wires 24 from switch 15 should be as small and as flexible as practical within legal and safety considerations. Wires 24 should be looped on their path to a terminal block (not shown) to permit movement of mercury switch 15 with minimum distortion of wires 24 so that they do not cause a significant resistance to rotation of shaft 11, 12 and 13 or to movement of bimetallic coil 14.

Before final assembly, the response of humidity sensitive member 9 should be tested to correct for any likely differences in techniques and materials used by the inventor and by the reader. A temporary balanced pointer (not shown) of minimum weight should be attached to the outboard end of center shaft 11 and a temporary scale (not shown) showing degrees of rotation attached to the outboard bearing bracket 18 in place of thermometer 19, 20 and 21. These temporary additions permit an observation of shaft rotation as a function of percent relative humidity. Observations should be made with slots 8 oriented radially with respect to shaft 11, 12 and 13. For the test, the assembly should be subjected to two widely different atmospheres of humidity (for example 20% and 80% R.H.). After allowing for equilibrium, the pointer's position should be noted for each condition of relative humidity. As an example, assume that bimetallic coil 14 rotates switch 15 1 degree for a 1 degree F. change in temperature, and relative humidity test conditions are 20% and 80% R.H. For these conditions the temporary pointer should shown a rotation of:

60% change in R.H./8% R.H./1 degree F.=7.5 degrees F.

Since in this case 1 degree F.=1 degree of rotation, the temporary pointer should rotate 7.5 degrees which is needed to generate the average slope of −8% R.H./1 degree F. for the function of comfort shown by FIGS. 1 and 2.

If the proper rotation is not obtained, then the dimensions of humidity sensitive member 9 must be changed as described earlier. Once a satisfactory combination of the reader's materials and techniques has been established, then duplicate humidity sensitive members 9 will shown little deviation from the desired calibration. Small deviations in calibration can be corrected by adjusting the angle of slots 8, but most of this adjustment should be reserved for the future user who wants a slope other than −8% R.H./1 degree F. for his function of comfort as shown by FIGS. 1 and 2.

Bimetallic thermometer 19, 20 and 21 is attached to outboard bearing bracket 18. Its temperature scale 21 should cover the same temperature range with the same degrees of rotation as covered by bimetallic coil 14 carrying mercury switch 15. Thermometer 19, 20 and 21 should be centered on center shaft 11 without touching center shaft 11 so that pointer 16 can use temperature scale 21 as an approximate control point.

In a typical heating application using the described comfort controller, as heat is applied to a room, bimetallic coil 14 responds in a direction to open switch 15 when the temperature control point is reached. However, during this transient heat-up period humidity sensitive member 9 responds to the resulting lower relative humidity and tries to move switch 15 in a direction opposite to that of bimetallic coil 14. This opposing action of bimetallic coil 14 and humidity sensitive member 9, in effect, increases the measuring lag of the comfort controller compared to a conventional bimetallic actuated thermostat. For this reason an anticipator for a comfort controller on a heating application requires a higher heat setting than a conventional thermostat. Since bimetallic coil 14 and humidity sensitive member 9 are thermally spaced, nothing precludes the use of a conventional anticipator. However, for the preferred embodiment, humidity sensitive member 9 should be isolated as much as practical from the heat of the anticipator. This can be done by orienting humidity sensitive member 9 to one side or below bimetallic coil 14 and its heater. A foil type radiation shield such as metallized plastic for example may also be placed between bimetallic coil 14 and humidity sensitive member 9 for additional isolation.

In an air conditioning application using the same comfort controller in a region of high summer heat and humidity such as the South and Eastern U.S., the effect of simultaneous measurement of temperature and humidity is reverse to that found in a heating application. During the "air conditioner-off" part of the cooling cycle, increasing humidity causes humidity sensitive member 9 to rotate shaft 11, 12 and 13 in a direction to tilt mercury switch 15 to start the air conditioner. At the same time, bimetallic coil 14 mounted on shaft 11, 12 and 13 is also expanding as it warms to additionally tilt mercury switch 15 and start the air conditioner. These two additionally added responses result in an earlier start of the air conditioner compared to a bimetallic coil responding to temperature alone. This earlier start is the same result as obtained from a standard electrical-heat type anticipator without its disadvantages. This describe method for an anticipator has no electrical circuit, no added mass to slow the temperature response of the bimetallic coil and its adjustment is not complicated by external circuits.

The above description leads to a general method for making an anticipator for use when controlling an air conditioner in warm humid climates. The method requires additionally combining humidity and dry bulb temperature measurements in a predetermined ratio to so as to initiate cooling equipment operation earlier in the cooling cycle than would be done by a temperature measurement alone. In the preferred embodiment, the two measurements should be combined in a ratio of −8% R.H./1 degree F. with an adjustment of ratio between at least −5% R.H./1 degree F. and −11% R.H./1 degree F.

The comfort control method is expressly for use where there is no independent humidity control equipment. However, it may be used with humidity control equipment, but its effect by definition will be negligible.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. A temperature and humidity responsive thermostat for on-off control of a heating device or of a cooling device to maintain dry bulb temperature as a function of comfort in a habitable air space which has no direct humidity control equipment, said thermostat comprising a mounting base, a freely rotating shaft mounted on inboard and outboard bearings, said shaft being a means to carry a temperature sensitive bimetallic coil which in turn carries a mercury switch for on-off operation of a heating or of a cooling device, said temperature sensitive bimetallic coil said mercury switch and said shaft being rotationally positioned by one end of a humidity sensitive member that is fixed to said shaft, said humidity sensitive member being thermally isolated by spacing from said bimetallic coil as a means to permit the use of an anticipator, the opposite end of said humidity sensitive member being confined by slots to one direction of movement as a means to maximize said shaft's rotation as said humidity sensitive member bends in response to humidity changes, said slots additionally being a means to link said humidity sensitive member to a control point adjusting lever, said adjusting lever being frictionally restrained from rotation as a means to maintain a manually set control point, said adjusting lever additionally carrying a pointer, said pointer being a means to indicate a control point on an additionally attached scale, said scale being fixed in relation to said base and marked to show relative warmth or coolness.

2. A thermostat as recited in 1 further comprising the rotational movement of said humidity sensitive member when combined with the rotational movement of said bimetallic coil generate an average function of comfort of −8% relative humidity/1 degree Fahrenheit.

3. A thermostat as recited in 1 further comprising a rotational adjustment of said slots as a means for amplifying or attenuating the rotation of said shaft by said humidity sensitive member to generate a continuous range of functions of comfort above and below said average function of comfort of −8% Relative humidity/1 degree Fahrenheit.

4. A thermostat as recited in 3 in which said rotational adjustment of said slots provide a means to generate a range of functions of comfort from −5% Relative humidity/1 degree Fahrenheit to −11% Relative humidity/1 degree Fahrenheit.

5. A thermostat as recited in 1 further comprising adjustment of said control point adjustment lever to cover a range of at least 60 degrees Fahrenheit to 85 degrees Fahrenheit.

6. A thermostat as recited in 1 further comprising an operating range of said humidity sensitive member of at least 10% relative humidity to 95% relative humidity.

* * * * *